US007527235B2

(12) United States Patent
Hummel

(10) Patent No.: US 7,527,235 B2
(45) Date of Patent: May 5, 2009

(54) GREETING CARD HOLDER

(76) Inventor: Timothy B. Hummel, P.O. Box 1184, Oklahoma City, OK (US) 73101

( * ) Notice: Subject to any disclaimer, the term of this patent is extended or adjusted under 35 U.S.C. 154(b) by 215 days.

(21) Appl. No.: 11/171,951

(22) Filed: Jun. 30, 2005

(65) Prior Publication Data

US 2007/0001069 A1 Jan. 4, 2007

(51) Int. Cl.
*A47B 97/04* (2006.01)

(52) U.S. Cl. ..... 248/459; 248/300; 248/460; 248/453; 248/454; 248/455; 248/451; 40/124.01; 40/124.08; 40/124.16; 40/750; 40/754; 40/755

(58) Field of Classification Search ..... 248/300, 248/459, 460, 453–455, 451; 40/124.01, 40/124.08, 124.16, 750, 754, 755
See application file for complete search history.

(56) References Cited

U.S. PATENT DOCUMENTS

| | | | | | |
|---|---|---|---|---|---|
| 438,185 | A | * | 10/1890 | Rosewater | 248/459 |
| 1,146,103 | A | * | 7/1915 | Roy | 248/459 |
| 1,435,658 | A | * | 11/1922 | Prehn | 248/459 |
| 1,621,754 | A | * | 3/1927 | Rommel | 40/124.16 |
| 1,704,561 | A | * | 3/1929 | Egan | 248/453 |
| 1,719,503 | A | * | 7/1929 | Egan | 248/453 |
| 1,821,025 | A | * | 9/1931 | Ohlson | 40/124.16 |
| 1,897,305 | A | * | 2/1933 | Doherty | 248/459 |
| 2,003,244 | A | * | 5/1935 | Carboni | 211/88.01 |
| 2,252,571 | A | * | 8/1941 | Kohn | 248/459 |
| 2,506,461 | A | * | 5/1950 | Leach | 40/124.16 |
| 2,553,174 | A | * | 5/1951 | Cross | 248/459 |
| 2,654,554 | A | * | 10/1953 | Cross | 248/459 |
| 2,726,835 | A | * | 12/1955 | Hummel | 248/459 |
| 2,920,409 | A | * | 1/1960 | Sampson | 40/122 |
| 2,946,545 | A | * | 7/1960 | Sampson | 248/459 |
| 3,275,281 | A | * | 9/1966 | Sampson | 248/465 |
| 3,447,770 | A | * | 6/1969 | Gallamos | 248/453 |
| 3,460,795 | A | * | 8/1969 | Dahlin | 248/452 |
| 3,797,150 | A | | 3/1974 | Hinckley | |
| 4,184,276 | A | | 1/1980 | Hernandez | |
| 4,291,798 | A | * | 9/1981 | Transport | 206/45.24 |
| 4,460,146 | A | * | 7/1984 | Raggiotti | 248/456 |
| 4,674,724 | A | * | 6/1987 | Gaudet | 248/459 |
| 4,826,445 | A | | 5/1989 | Verhoeven et al. | |
| 5,178,415 | A | | 1/1993 | Tremaine | |
| 5,297,677 | A | * | 3/1994 | Burian et al. | 206/362.4 |
| 5,335,796 | A | | 8/1994 | Sanford et al. | |
| 5,435,085 | A | | 7/1995 | Johnson | |
| 5,458,242 | A | * | 10/1995 | Baka et al. | 206/488 |

(Continued)

FOREIGN PATENT DOCUMENTS

| | | |
|---|---|---|
| GB | 1085593 | 10/1967 |

(Continued)

*Primary Examiner*—J. Allen Shriver, II
*Assistant Examiner*—Michael McDuffie
(74) *Attorney, Agent, or Firm*—McAfee & Taft

(57) ABSTRACT

The current invention provides a card holder for displaying a card on a flat horizontal surface. The card holder is substantially adhesive free and can be mailed in a flat configuration with a greeting card in a greeting card envelope. The card holder comprises a panel having tabs that are extendable outwardly from the panel and arranged in a pattern to secure the edges of the card, thus allowing the card to be displayed in a stable manner.

35 Claims, 8 Drawing Sheets

U.S. PATENT DOCUMENTS

| | | | | |
|---|---|---|---|---|
| 5,607,135 | A * | 3/1997 | Yamada | 248/456 |
| 5,782,357 | A | 7/1998 | Johnson | |
| 6,017,012 | A | 1/2000 | Henson, Jr. | |
| 6,227,504 | B1 | 5/2001 | Seaberg | |
| 6,672,549 | B2 * | 1/2004 | Kolb | 248/127 |
| 7,182,305 | B2 * | 2/2007 | Dempsey | 248/459 |
| 2002/0056213 | A1 | 5/2002 | Van Der Meer | |
| 2003/0024839 | A1 | 2/2003 | Fulda | |
| 2003/0037851 | A1 | 2/2003 | Hogganvik | |
| 2003/0217497 | A1 | 11/2003 | Nagel | |
| 2004/0245413 | A1 * | 12/2004 | Dempsey | 248/150 |

FOREIGN PATENT DOCUMENTS

| | | |
|---|---|---|
| JP | 2003-216039 | 7/2003 |

* cited by examiner

GREETING CARD HOLDER

BACKGROUND OF THE INVENTION

This invention relates to an improved device for holding and displaying a single greeting card or the like. In particular, the current invention provides a mailable card holder suitable for displaying cards folded either vertically or horizontally.

Greeting cards are exchanged year round but are especially popular at Christmas. Recipients often display the cards by stacking them in a tray or bowl, by attaching them to a wall using ribbons, tacks, tape or glue, or by standing them upright on a flat surface such as a table top or mantel.

Each of these display methods suffer from shortcomings. The stacking approach requires handling of the cards to view them. Attaching the cards to a wall leaves marks on the wall and precludes close examination of the cards. Finally, cards standing upright on a surface are easily knocked over.

Therefore, a need exists for a small, economical, and disposable device for displaying greeting cards which overcomes the problems described above.

SUMMARY OF THE INVENTION

The present invention provides a method and device for holding and displaying a card such as a greeting card. The card holder can be mailed in a flat configuration with a greeting card in a greeting card envelope. The size and weight of the card holder is preferably equal to or less than the greeting card. The holder may be configured to display a card having a horizontal fold in an upright tent position. Additionally, the holder may be configured to display a card having a vertical fold in an upright book position. Finally, if the card is not folded, then the holder may be configured to display the card in an upright position.

In one embodiment, the card holder of the present invention comprises a panel, preferably a single piece of paperboard stock or bendable light plastic. The panel preferably comprises a plurality of opposing tabs which may be bent outwardly from the panel. The tabs are aligned such that when the panel is lying on a horizontal surface, the outwardly extending tabs securely retain one or more bottom edges of the greeting card. When the tabs are oriented in a V pattern, the card holder can secure a card in a book orientation. When the tabs are oriented in two or more parallel lines, the card holder can secure a card in a tent configuration. Preferably, the card holder can accommodate a card in either a tent or book position.

In another embodiment, the current invention provides a greeting card holder comprising a panel which carries a card supporter having at least two sidewalls defining a V. The V is suitable for receiving the folded edge of a greeting card thereby providing support for the greeting card. Additionally, the card supporter may be folded to a substantially flat position.

The present invention also provides a method for displaying a greeting card comprising the following steps. According to the method of the current invention, a flat panel prepared from a suitable paper stock or plastic is cut to a desired configuration corresponding to the card to be displayed. Subsequently, tabs are severably scored into the panel. Optionally, the portion of the tab which remains attached to the panel may be lightly scored to aid in flexing of the tab. Thereafter, the desired tabs are pushed outwardly from the panel. The tabs are bent along the intact edge retaining the tab to the panel in a manner suitable for engaging a card. Following positioning of the desired tabs, a greeting card is positioned on the card holder for display.

The foregoing and other advantages and features of the present invention will become apparent upon reading the following detailed description in conjunction with the accompanying drawings.

BRIEF DESCRIPTION OF THE DRAWINGS

FIG. 6A is a perspective view of another embodiment of the current invention.

FIG. 6B is a perspective view of a card displayed on the embodiment of FIG. 6A.

DETAILED DESCRIPTION OF THE PREFERRED EMBODIMENTS

Figure 1A:
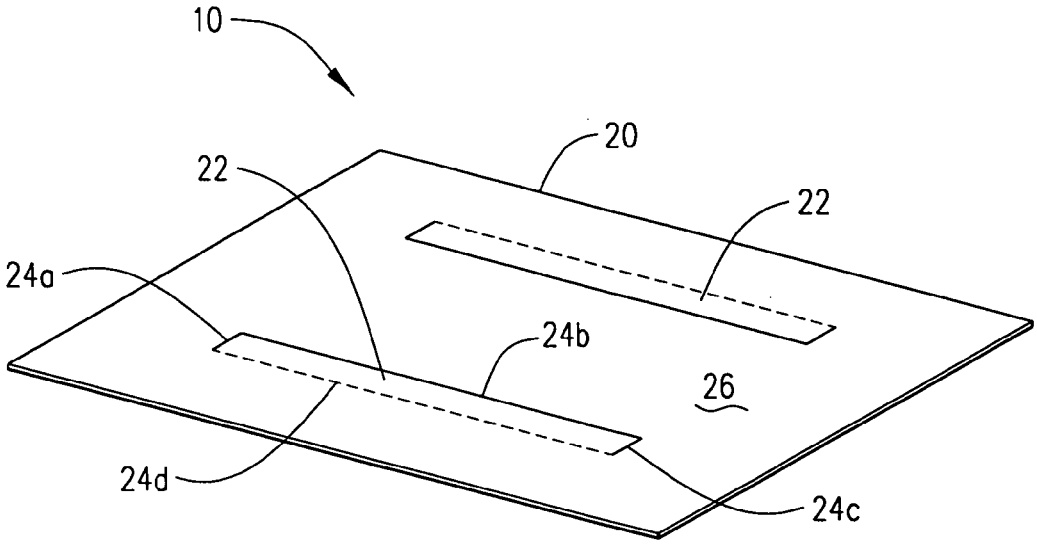
FIG. 1A is a perspective view of one embodiment of the current invention.

FIGS. 1A through 4C depict preferred embodiments of the current invention. In the embodiment of FIG. 1A, a card holder 10 comprises a panel 20 having at least two parallel severably scored tabs 22. Tabs 22 are severably scored on three edges 24*a*, 24*b*, 24*c*. Tab 22 is optionally lightly scored on edge 24*d* to aid in flexing of tab 22 to an outward position as depicted in FIG. 1B.

As used herein, the term "severably scored" includes perforations, cuts or other similar localized breakaway mechanisms completely or substantially through panel 20, which permit separation of edges 24*a*, 24*b*, 24*c* from panel 20 by application of force. Preferably, one would be able to move severably scored tab 22 by slight application of pressure with a finger. Edge 24*d* can be made totally by movement of tab 22 or this portion of tab 22 can be lightly scored to assist in the bending or folding of tab 22. Light scoring is especially useful when tab 22 is elongated as in FIGS. 1A and 1B.

Figure 1B:
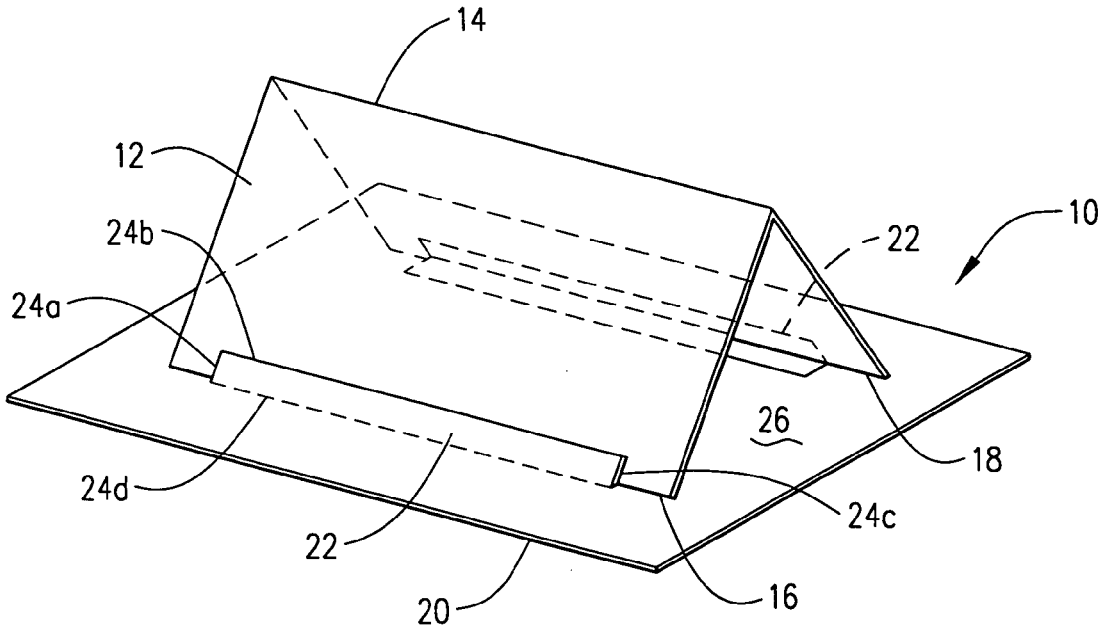
FIG. 1B is a perspective view of a card displayed in a tent configuration on the device depicted in FIG. 1A.

FIG. 1B depicts card holder 10 displaying a greeting card 12 in a tent position. Greeting card 12 has a horizontal fold 14 and first and second edges 16 and 18. In this embodiment, tab 22 restricts movement of card 12 precluding card 12 from collapsing under its own weight. Thus, card holder 10 provides the ability to display card 12 in a tent configuration without the use of separate retaining devices.

In a preferred embodiment, card holder 10 is configured from a panel 20. Panel 20 can be constructed of any lightweight material capable of being scored and bent or folded. Preferably, panel 20 is constructed of paperboard stock or plastic. Non-limiting examples of suitable paperboard stock include tag board, letter paper stock, card stock, card board, kraft paper and the like. In general, the material used to construct card holder 10 should be a single sheet which retains a desired configuration following bending. Thus, following bending, tabs 22 will remain extended from panel 20.

Panel 20 can be manufactured and/or sold with greeting card 12. Panel 20 is flat and lightweight and therefore easily mailed with card 12 in the card envelope (not shown). Panel 20 can optionally be decorated to match or complement card 12 such that the overall appearance of displayed card 12 and card holder 10 is pleasing to a viewer. Panel 20 is also quickly and easily converted to card holder 10 by pushing tabs 22 outward from panel surface 26 and folding or bending the unsevered edge 24*d* such that tab 22 maintains its extended position. Preferably, card holder 10 has a size less than or equal to card 12 to be displayed. Further, card holder 10 preferably has a weight equal to or less than the weight of card 12.

Figure 2A:
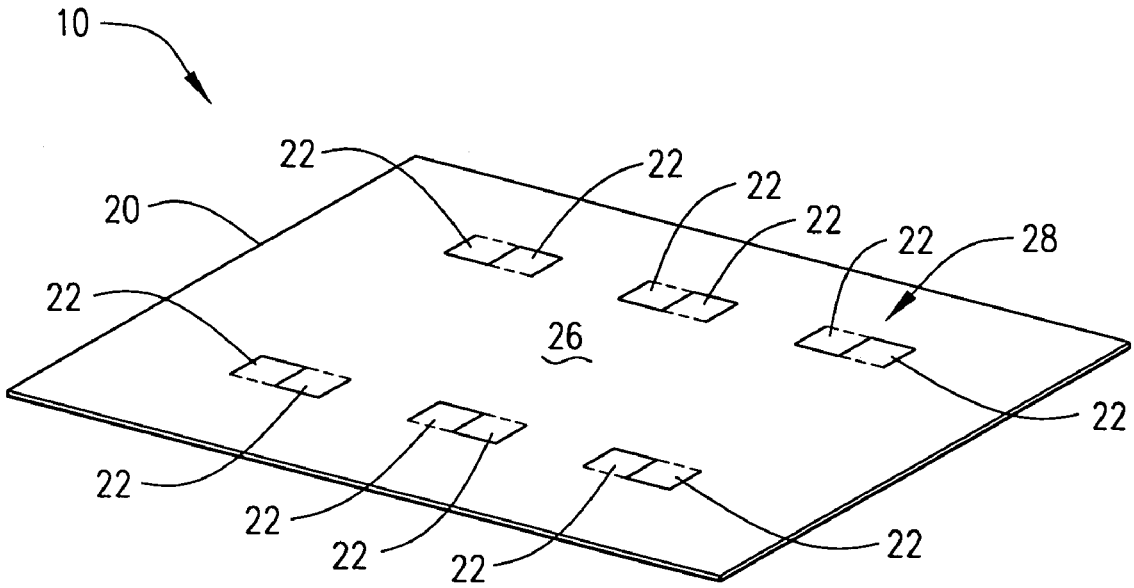
FIG. 2A is a perspective view of a panel scored for pairs of tabs.
Figure 2B:
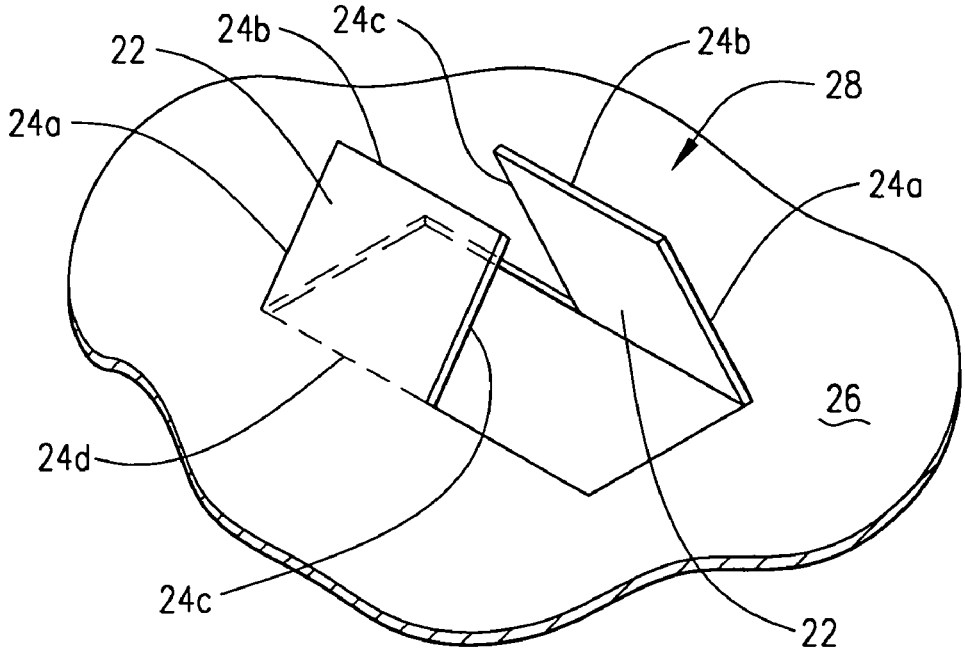
FIG. 2B depicts a pair of tabs wherein a single scoring forms adjacent side edges of each tab.
Figure 2C:
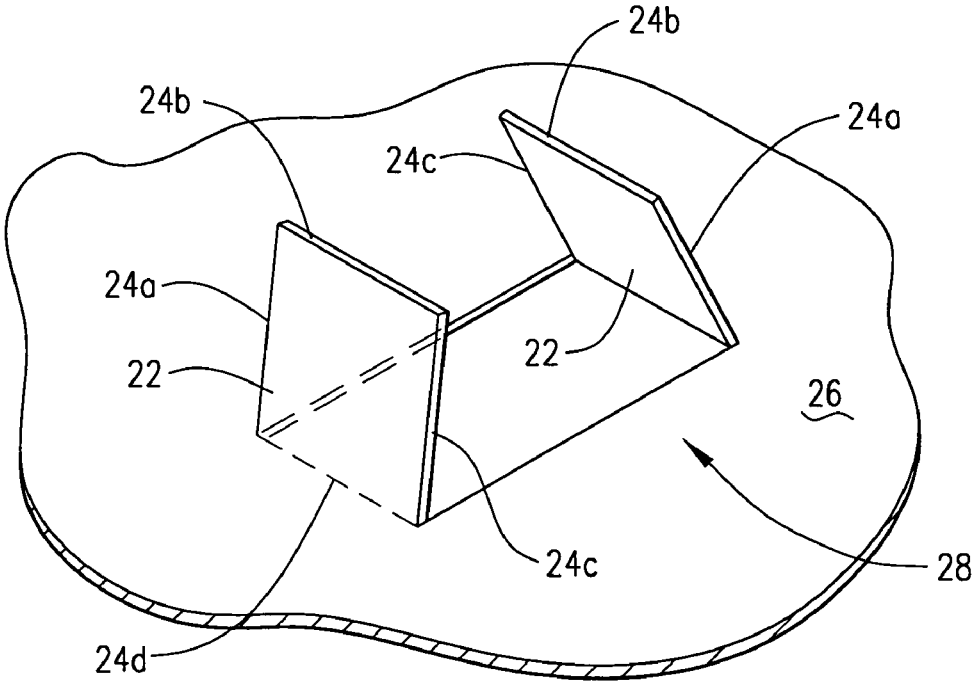
FIG. 2C depicts a pair of tabs wherein a single scoring forms the top edges of each tab in the pair of tabs.

It is sometimes desirable to more securely retain card edges 16, 18. With reference to FIG. 2A, one embodiment of the current invention provides a panel 20 having pairs of opposing tabs 22. As shown in FIG. 2B, tab pairs 28 comprise tabs 22 partially extend from surface 24 of panel 20 at acute angles by raising edges 24*a*, 24*b*, 24*c* and bending at edge 24*d*. Tab pairs 28 are aligned in parallel lines or rows in a manner suitable for securing card edges 16 and 18 when greeting card 12 is displayed in a tent position, as in FIG. 1A. As depicted in FIG. 2B, edge 24*d* of one tab 22 does not contact the corresponding edge 24*d* of the other tab 22 in tab pair 28. In the embodiment depicted, edges 24*c* of each tab 22 are prepared by a single scoring of panel 20. However, the current invention also contemplates an arrangement of tab pairs 28 wherein edges 24*b* of each tab 22 are prepared by a single scoring of panel 20. This embodiment is depicted in FIG. 2C.

Figure 2D:
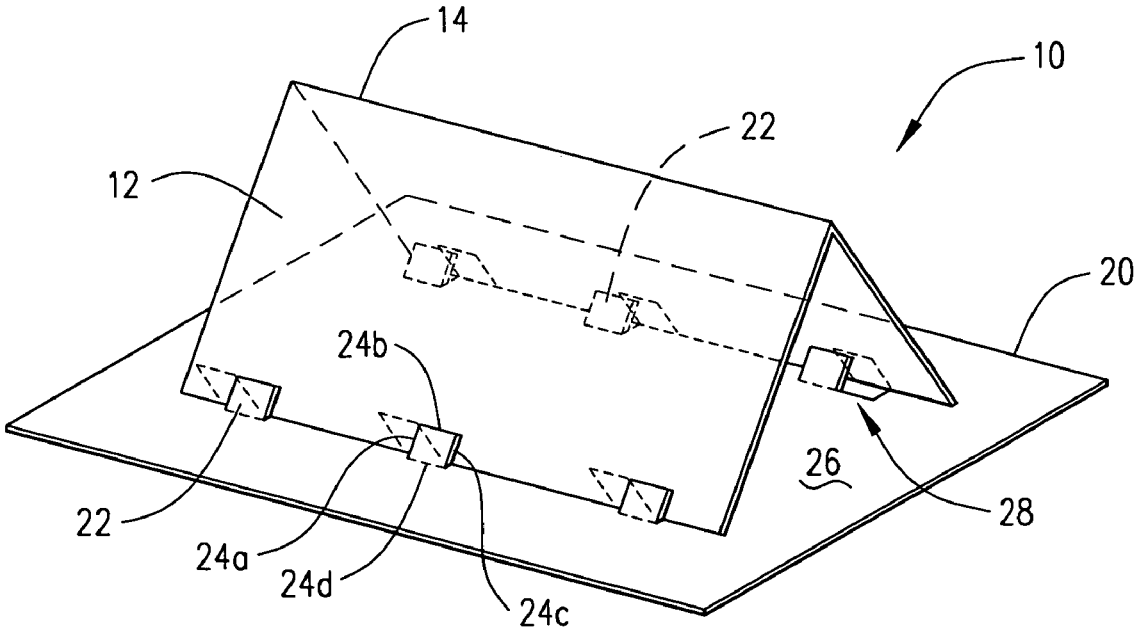
FIG. 2D depicts a pair of tabs with a card edge positioned between the tabs of the embodiment of FIG. 2A.

In either format, tabs 22 are bent outward from panel 20 at an angle appropriate to engage greeting card 12 positioned on card holder 10. Preferably, opposing top tab edges 24*b* engage each side of card edges 16, 18 as depicted in FIG. 2D. By positioning tabs 22 on each side of card edge 16 or 18, this embodiment provides additional stability to greeting card 12.

Figure 3A:
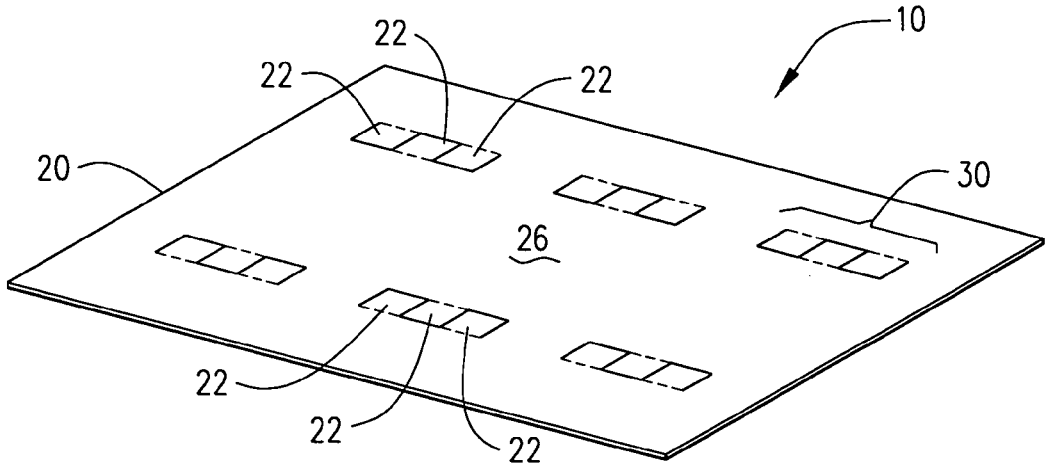
FIG. 3A is a perspective view of a panel scored for a plurality of opposing tabs.
Figure 3B:
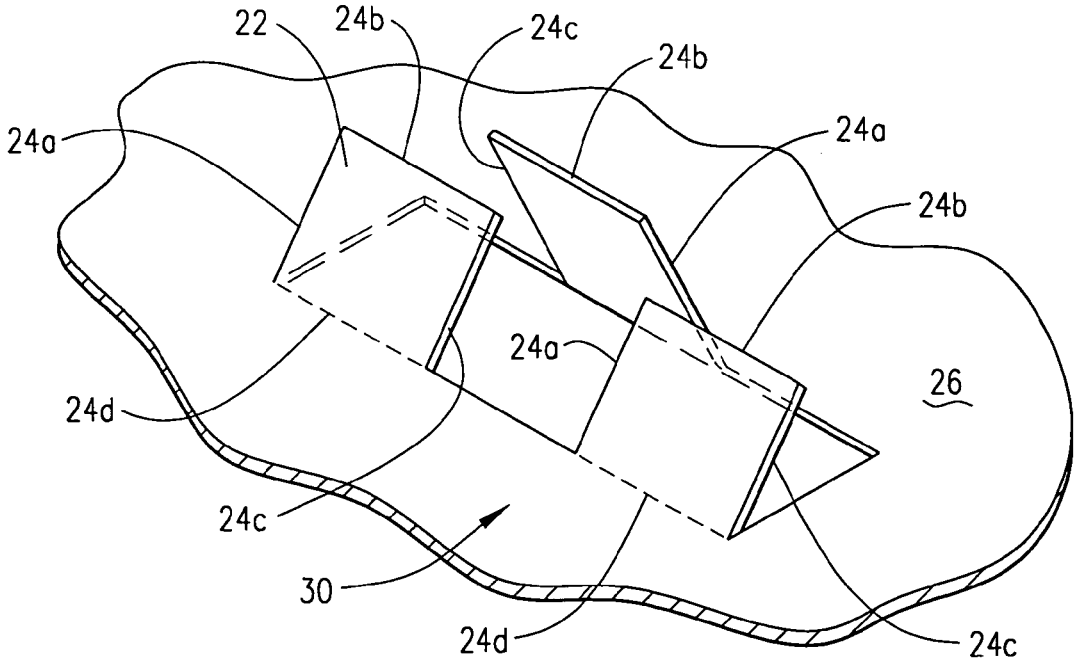
FIG. 3B depicts an enlarged view of a tab cluster.

With reference to FIGS. 3A and 3B, tabs 22 can be arranged in pairs 28 or in clusters 30 of three or more. FIG. 3A shows a panel 20 with parallel lines of tab clusters 30 wherein each tab cluster 30 comprises three tabs 22. However, cluster 30 may comprise any number of tabs 22. Tab clusters 30 are particularly useful for displaying unfolded cards 12 such as business cards (not shown).

Figure 3C:
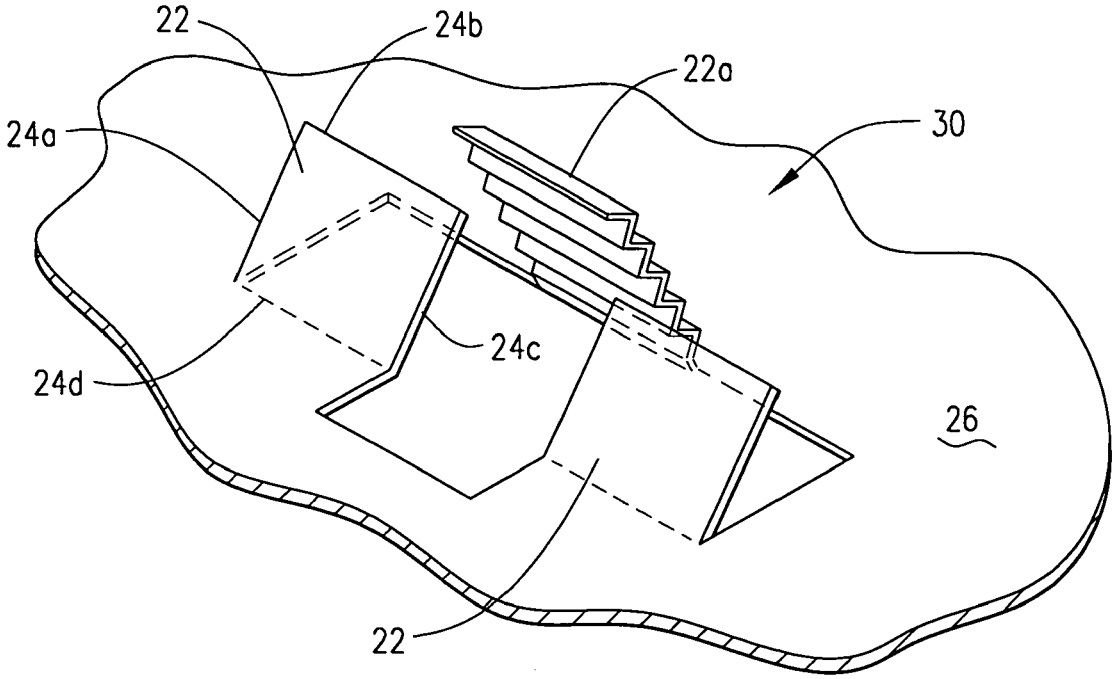
FIG. 3C depicts an alternative embodiment of the tab cluster.

FIG. 3C schematically shows a variation wherein the middle tab 22*a* of three-tab cluster 30 is folded or kinked in accordion fashion. It is believed that providing one or more accordion folded tabs 22*a* to tab cluster 30 improves the gripping action of tab clusters 30. Tabs 22*a* to be folded in accordion fashion are preferably longer than tabs 22. Preferably, accordion fold lines 32 are marked or lightly scored onto tabs 22*a*.

Figure 4A:
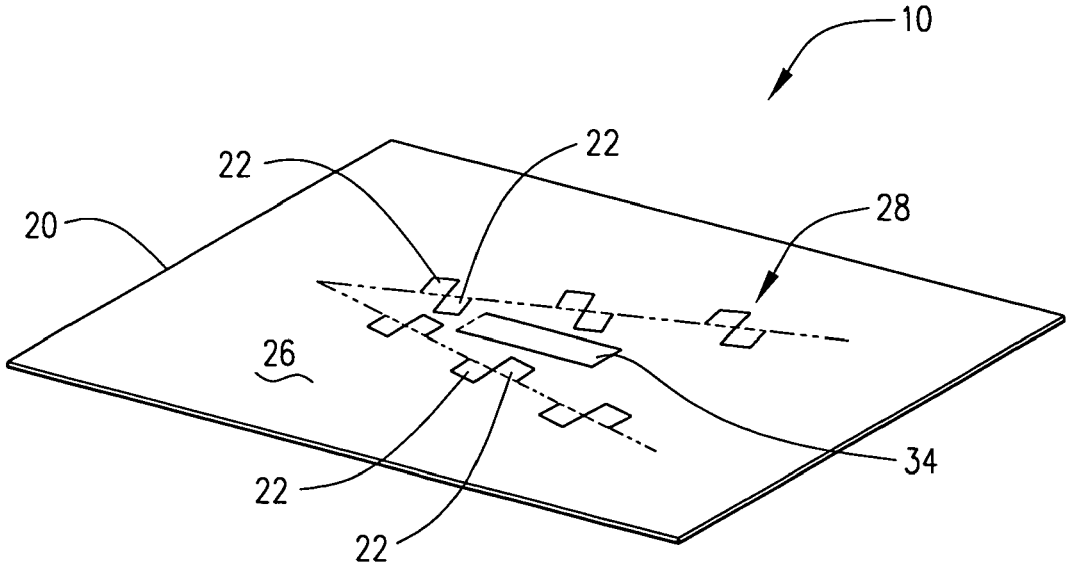
FIG. 4A is a perspective view of one embodiment of the current invention.
Figure 4B:
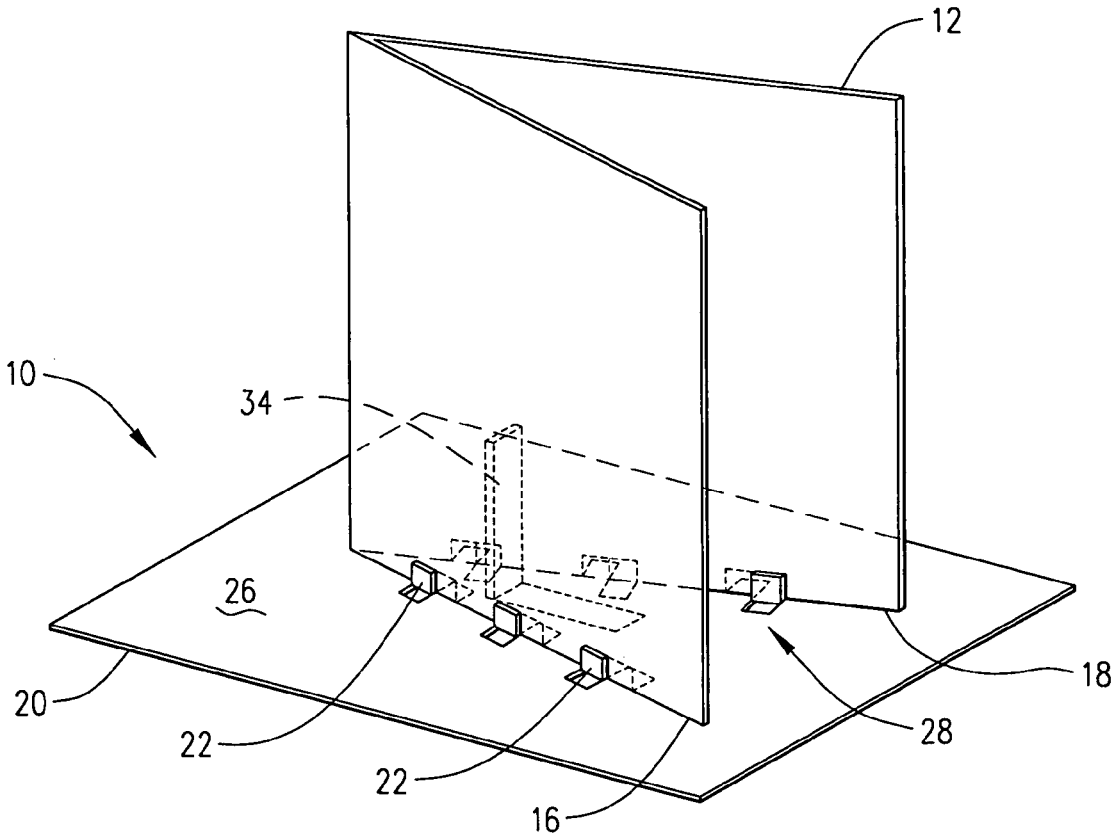
FIG. 4B is a perspective view of a card displayed in a book configuration on the device of this invention.

FIG. 4A depicts another embodiment of the current invention. This embodiment comprises panel 20 with a series of tabs 22 arranged in a V-shaped configuration. As noted above, tabs 22 are severably scored into panel 20. When extended from panel 20, tabs 22 engage card 12 placed on card holder 10. In a preferred embodiment, at least one tab 22 is positioned on each side of card edges 16 and 18. More preferably, as shown in FIG. 4B, at least two tabs 22 are positioned on either side of card edges 16 and 18. Optionally, a stabilizing tab 34 is carried by panel 20 in the gap formed by the V-shaped arrangement of tabs 22. Stabilizing tab 34 preferably has a length equal to at least half of the height of card 12 when displayed in a book position. Stabilizing tab 34 is severably scored in the manner of tabs 22. Although not depicted in FIGS. 1A and 1B, stabilizing tab 34 may be incorporated into the embodiment depicted therein. As depicted in FIG. 4B, stabilizing tab 34 provides additional support to card 12.

FIG. 4B depicts card holder 10 displaying greeting card 12 in a book position. Greeting card 12 has a vertical fold 14 and first and second edges 16 and 18. Cards 12 placed in this position without a holder usually fall over when touched, brushed against, or subjected to even slight air movement. This embodiment of card holder 10 improves the stability of card 12 when displayed in a book position. In this embodiment, card holder 10 provides a wide, secure base for card 12. Tab pairs 28 or clusters 30 secure edges 16 and 18 of card 12, thus maintaining an upright position and effectively integrating card holder 10 with card 12.

Figure 4C:
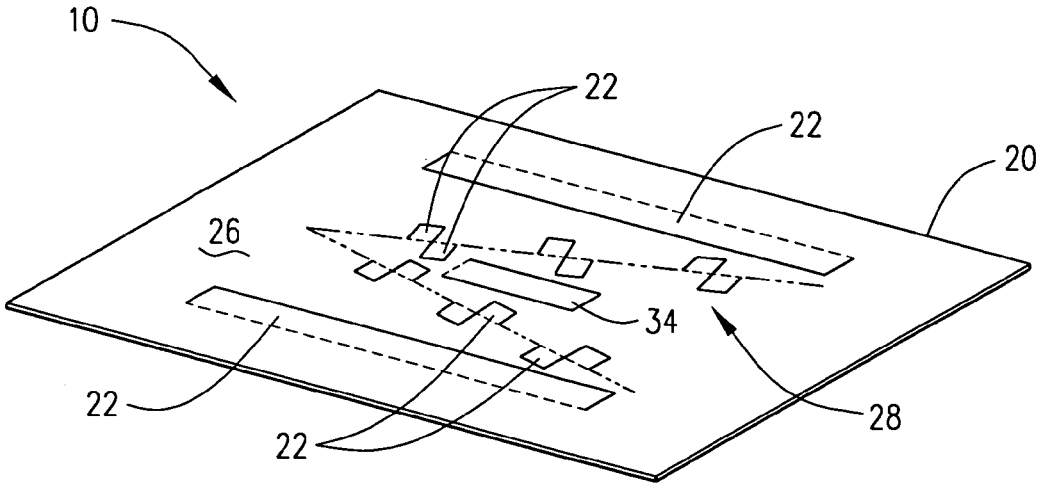
FIG. 4C is a perspective view of a card holder capable of displaying a card in more than one configuration.

Referring to FIG. 4C, another preferred embodiment comprises card holder panel 20 having parallel elongated tabs 22, tab pairs 28 or tab clusters 30 (tab clusters 30 not shown in FIG. 4C) capable of displaying and providing support to card 12 in a tent position, as well as tab pairs 28 or clusters 30 arranged in a V pattern capable of displaying and providing support to card 12 in a book position.

Figure 5A:
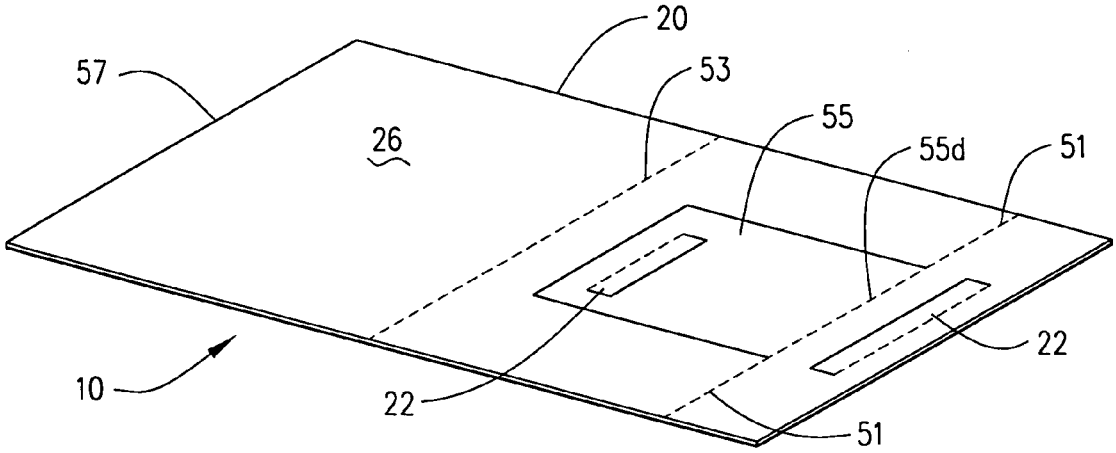
FIG. 5A is a perspective view of another embodiment of the current invention.

FIG. 5A depicts another preferred embodiment of the current invention. Card holder 10 depicted in FIG. 5A is suitable for displaying greeting cards in the tent position and for displaying postcards 13 or other cards which do not incorporate a fold in their design. As depicted in FIG. 5A, panel 20, used to form this embodiment of card holder 10, preferably has two pre-folded or lightly scored lines 51 and 53. A base tab 55 is severably scored into panel 20 in a manner similar to tabs 22 described above. Base tab 55 carries at least one severably scored tab 22. At least one additional severably scored tab 22 is positioned adjacent to the secured edge 55*d* of base tab 55.

Figure 5B:
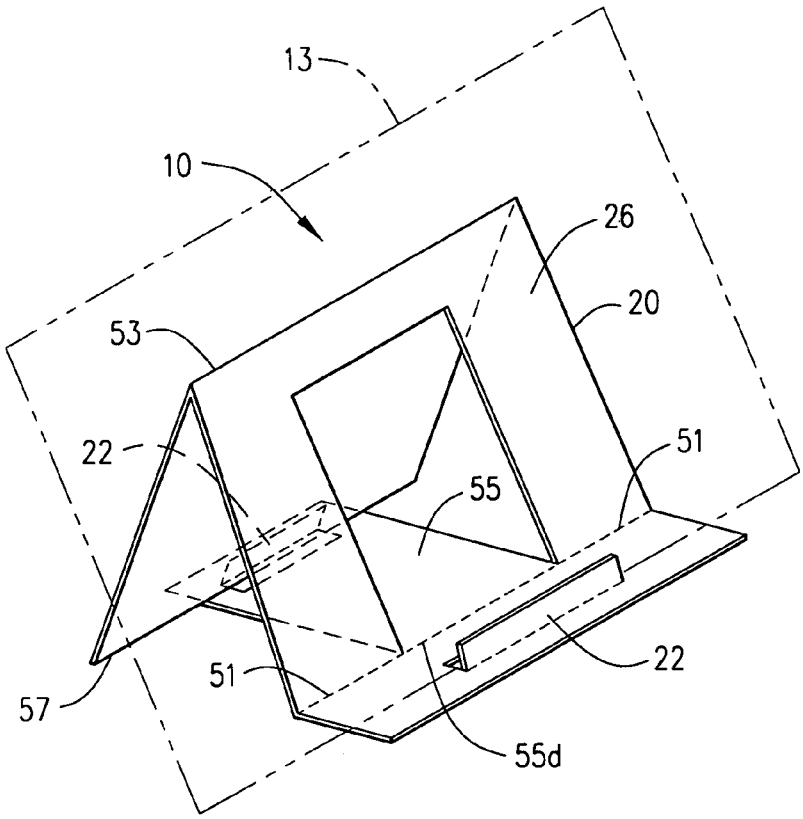
FIG. 5B is a perspective view of a postcard displayed on the embodiment of FIG. 5A.
Figure 5A:
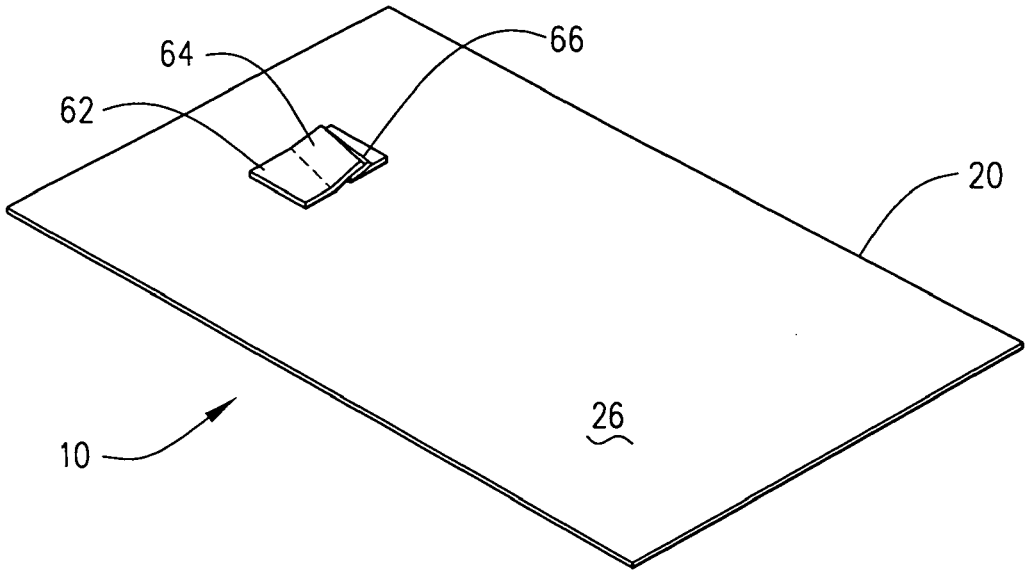
Figure 5B:
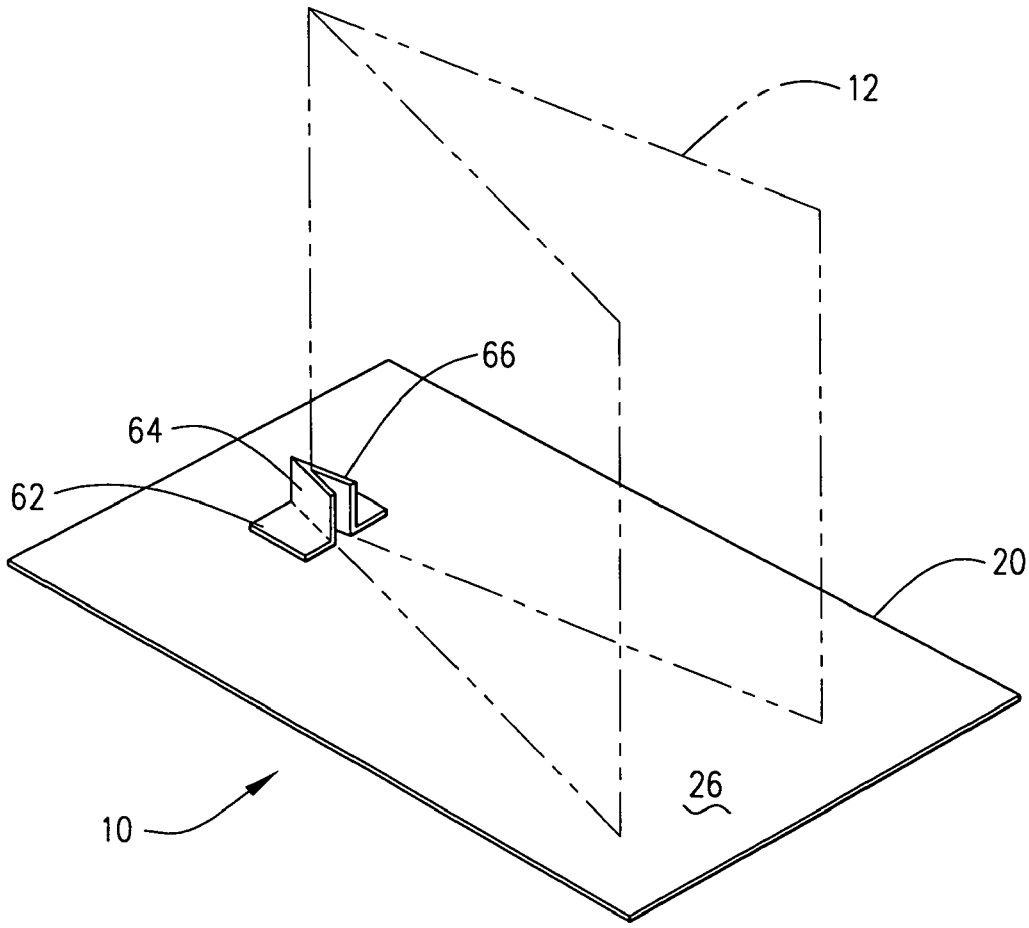

When positioned as depicted in FIG. 5B, card holder 10 provides a support for displaying postcard 13. As depicted, panel 20 is bent along pre-folded lines 51 and 53. Base tab 55 is separated from panel 20 and lies adjacent to the surface (not shown) supporting panel 20. Tab 22 carried by base tab 55 is bent upwards in manner sufficient to engage and retain edge 57 of panel 20. Following engagement of edge 57 with tab 22 carried by base tab 55, card holder 10 is ready to display a post card 13 or other similar card lacking a fold. When displaying a postcard 13, tab 22 adjacent to edge 55*d* retains lower edge 13*a* of postcard 13 while card holder 10 presents postcard 13 at an angle suitable for viewing.

In yet another embodiment, the current invention depicted in FIG. 6A and FIG. 6B, provides a card holder 60 which does not require scoring of panel 20. In the embodiment shown in FIG. 6A, a card supporter 62 is secured to surface 26 of panel 20. Card support 62 is preferably sufficiently flexible to permit folding to a substantially flat position as shown in FIG. 6A thereby permitting mailing of card holder 60 in a conventional envelope. When moved to an upright position as depicted in FIG. 6B, card supporter 62 has a generally V-shaped configuration defined by sidewalls 64 and 66.

As shown in FIG. 6B, greeting card 12 is displayed in book configuration with fold 14 inserted into the V defined by sidewalls 64 and 66. Thus, card supporter 62 provides sufficient stability to enable display of card 12. Card support 62 may be utilized alone or in combination with the embodiments of the current invention depicted in FIGS. 4A, 4B and 4C.

The current invention further provides a method for configuring a greeting card holder 10 from a flat panel 20 of paperboard, plastic or other similar material. According to the method of the current invention, a panel 20 of desired material is cut to a size suitable for displaying the desired greeting card 12. The dimensional size will depend in part on the configuration of card 12. As will be apparent from an examination of FIGS. 1B and 4B, the width and length of card holder 10 will be determined by the dimensions of card 12 and the location/configuration of fold 14.

Following sizing of card holder 10, tabs 22 are severably scored into panel 20. The methods for scoring tabs 22 in paperboard and plastic are well known to those skilled in the art. Although tabs 22 are portrayed in the FIGS. as square or rectangular in shape, it is understood that any shape will work. Preferably, the scoring permits extension of tabs 22 from panel 20 by slight pressure applied with a finger or pencil eraser. Tabs 22 are subsequently positioned in a manner to engage card 12 placed on card holder 10.

As noted above, a stabilizing tab 34 may also be scored into panel 20. If stabilizing tab 34 is provided, it is also extended and positioned to provide further support to card 12.

Once necessary tabs 22 are positioned outwardly from panel 20, greeting card 12 is positioned on card holder 10. Tabs 22 provide sufficient friction to stabilize card 12 reducing the likelihood of card 12 collapsing or falling over.

The above description refers frequently to greeting cards; however, it is understood that card holder 10 of the current invention can be used advantageously to display business cards, card-size advertising plaques, informational signs in stores, unframed decorative cards and so on. The card holder of this invention also offers a unique marketing tool in that it is an inexpensive, disposable, functional and decorative tool for displaying a card and can be sold and/or mailed with the card marketed.

While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A greeting card holder comprising:

a panel having a first severably scored tab and a second severably scored tab, said severably scored tabs being readily separated along three edges from said panel while a fourth edge retains a connection with said panel;

a base tab formed from said panel, said base tab having a plurality of severably scored edges and a lightly scored edge joining said base tab to said panel;

wherein said first severably scored tab is positioned on said base tab and said second severably scored tab is positioned on said panel; and wherein, when bent, said first severably scored tab extends outwardly from said base tab and said second severably scored tab extends outwardly from said panel.

2. The greeting card holder of claim 1, wherein the surface of said panel and said tabs are substantially free of adhesive.

3. The greeting card holder of claim 1, wherein said fourth edge of said tabs is lightly scored.

4. The greeting card holder of claim 1, wherein said tabs are arranged in at least two parallel rows.

5. The greeting card holder of claim 1, wherein said panel is a paperboard stock or plastic.

6. The greeting card holder of claim 1, wherein said tabs are arranged in pairs.

7. The greeting card holder of claim 6, wherein a fourth edge of one tab in a pair does not contact the fourth edge of the other tab in the pair.

8. The card holder of claim 1, wherein the weight of the card holder is less than or equal to the weight of a greeting card associated with said holder and to be displayed by said holder.

9. The card holder of claim 5, wherein said paperboard stock retains its configuration following bending of said tabs.

10. The card holder of claim 5, wherein said plastic retains its configuration following bending of said tabs.

11. A card holder comprising:

a panel having at least two pre-folded or lightly scored lines, said pre-folded or lightly scored lines substantially crossing said panel, said panel carrying a severably scored base tab, said base tab having one edge which does not separate from said panel; said severably scored base tab carrying a first severably scored tab; and said panel having a second severably scored tab positioned between said edge of said base tab which remains attached to said panel and an outer edge of said panel when said card holder is in an assembled state.

12. The card holder of claim 11, wherein said severably scored tabs are readily separated along thee edges from said panel while a fourth edge retains a connection with said panel.

13. The card holder of claim 11, wherein said panel is a paperboard stock or plastic.

14. The card holder of claim 13, wherein said paperboard stock retains its configuration following bending of said tabs.

15. The card holder of claim 13, wherein said plastic retains its configuration following bending of said tabs.

16. A card holder comprising:

a panel having at least two pre-folded, Lightly scored lines that substantially cross from a first edge of the panel to an opposite edge;

a base tab formed from the panel, the base tab having at least one tab, wherein the base tab is substantially parallel to and in contact with a fiat surface supporting the card holder when said card holder is in an assembled state, and, wherein the tab, relative to the base tab, extends outwardly away from the panel and the flat surface.

17. The card holder of claim 16, wherein the surface of the base tab and the tab are substantially free of adhesive.

18. The card holder of claim 16, wherein the tab has at least one edge retaining a connection with the base tab.

19. The card holder of claim 18, wherein said edge of said tab is lightly scored.

20. The card holder of claim 16, wherein the base tab is made of paperboard stock or plastic.

21. The card holder of claim 20, wherein said paperboard stock retains its configuration following bending of said tabs.

22. The card holder of claim 20, wherein said plastic retains its configuration following bending of said tabs.

23. The card holder of claim 16, wherein the weight of the card holder is less than or equal to the weight of a card to be displayed by said holder.

24. The card holder of claim 16, wherein there are at least two tabs and the tabs are parallel to each other.

25. A card holder comprising:

a panel carrying a base tab, the base tab having a single edge which does not separate from the panel, wherein the base tab has a first side and a second side and is movable to a position such that the base tab is substantially parallel to a flat surface supporting the card holder when said card holder is in an assembled state;

the base tab carrying a first tab; and, the panel having a second tab positioned between the single edge of the base tab which remains attached to the panel and an outer edge of said panel.

26. The card holder of claim 25, wherein the tabs have at least one edge retaining a connection with the panel.

27. The card holder of claim 26, wherein the panel is a paperboard stock or plastic.

28. The card holder of claim 27, wherein the paperboard stock retains its configuration following bending of said tabs.

29. The card holder of claim 27, wherein said plastic retains its configuration following bending of said tabs.

30. The card holder of claim 26 wherein a weight of the card holder is less than or equal to the weight of a card to be displayed by said holder.

31. A card holder comprising:

a panel;

a base tab severably scored and formed from the panel, said base tab having at least one edge which does not separate from said panel and at least one free edge that engages said panel;

at least two seams, wherein one of the seams coincides with said edge which does not separate from said panel and the other seam bisects a middle region of said panel; and wherein said panel is bent at said two seams to form a tent-like structure and wherein said engagement of said panel by said base tab retains said tent-like structure.

32. The card holder of claim 31, wherein said panel is a paperboard stock or plastic.

33. The card holder of claim 31 wherein a weight of said card holder is less than or equal to said weight of a card to be displayed by said holder.

34. A card holder comprising:

a panel;

a base tab severably scored and formed from the panel, the base tab having at least one edge which does not separate from the panel and at least one free edge that engages the panel;

at least two seams, wherein one of the scams coincides wit the edge which does not separate from the panel and the other seam substantially bisecting a middle region of the panel from a first side edge to a second side edge; and wherein the panel is bent at the two seams to form a tent-like structure and wherein the engagement of the panel by the base tab retains the tent-like structure.

35. A card holder comprising:

a panel carrying a severably scored base tab, the base tab having an edge in contact with the panel, wherein the base tab has a first side and a second side and is movable to a position such that the base tab is substantially parallel to a flat surface supporting the card holder when the card holder is in an assembled state;

the base tab carrying at least one tab positionable to extend outwardly from the base tab; and the panel having at least one tab positioned between the edge of the base tab which remains attached to the panel and an outer edge of the panel, wherein the tab is positionable to extend outwardly from the panel.

* * * * *